United States Patent [19]

Uematsu

[11] Patent Number: 4,551,887

[45] Date of Patent: Nov. 12, 1985

[54] DRAFT APPARATUS FOR A SPINNING MACHINE

[75] Inventor: Ikuzo Uematsu, Kyoto, Japan

[73] Assignee: Murata Kikai Kabushiki Kaisha, Japan

[21] Appl. No.: 580,878

[22] Filed: Feb. 16, 1984

[30] Foreign Application Priority Data

Feb. 21, 1983 [JP] Japan ..... 58-28270

[51] Int. Cl.[4] ..... D01H 5/72

[52] U.S. Cl. ..... 19/244; 19/246; 19/266; 19/286; 19/288

[58] Field of Search ..... 19/244, 236, 246, 248, 19/249, 252, 258, 266, 268, 286, 287, 288

[56] References Cited

U.S. PATENT DOCUMENTS

| | | | |
|---|---|---|---|
| 2,773,297 | 12/1956 | Cotchett | 19/288 X |
| 3,273,206 | 9/1966 | Carroll | 19/288 |
| 3,898,712 | 8/1975 | Blackburn et al. | 19/244 |
| 4,192,041 | 3/1980 | Sasaki et al. | 19/244 X |

FOREIGN PATENT DOCUMENTS

| | | | |
|---|---|---|---|
| 190588 | 1/1906 | Fed. Rep. of Germany | 19/244 |
| 298784 | 10/1928 | United Kingdom | 19/286 |
| 310958 | 4/1929 | United Kingdom | 19/286 |
| 736957 | 9/1955 | United Kingdom | 19/266 |
| 883823 | 12/1961 | United Kingdom | 19/248 |

*Primary Examiner*—Louis K. Rimrodt
*Assistant Examiner*—J. L. K. Olds
*Attorney, Agent, or Firm*—Spensley, Horn, Jubas & Lubitz

[57] ABSTRACT

Draft apparatus for use with a pneumatic high speed spinning frame. At least one pair of sliver compressing member are disposed on the sliver path. One of the sliver compressing members has a circumferential recessed groove for receiving the sliver and the other sliver compressing members has a circumferential rib adapted to be fitted into the recessed groove.

14 Claims, 13 Drawing Figures

DRAFT APPARATUS FOR A SPINNING MACHINE

BACKGROUND OF THE INVENTION

1. Field of the Invention:

This invention relates to a draft apparatus for use with a spinning machine, especially for use with a pneumatic high speed spinning frame.

2. Prior Art

In a pneumatic spinning frame, a roving step is omitted so that a sliver is directly drafted on a draft apparatus including a plurality of pairs of rollers. Accordingly, thickness, configuration and the like of a sliver supplied to the draft apparatus have a serious influence on the quality of a yarn obtained therefrom which is later spun on the spinning frame. Further, since a sliver is an aggregate of a large number of fibers, even slivers which include a same number of fibers of the same thickness may be apparently different in thickness depending upon a degree of compression thereof. It is known that generally as the apparent thickness of a sliver becomes thinner, or in other words, as the degree of compression becomes higher to some degree, a spinning yarn obtained from the sliver becomes better in spinnability and thus in quality. To this end, it has been proposed that a guide having a sliver path therein which narrows in a direction of advancement of a sliver is disposed backwardly of a draft apparatus so that a sliver may be passed through and compressed by the sliver path in order to reduce the apparent thickness of the sliver before it is supplied to the draft apparatus. However, this arrangement cannot successfully decrease an expanding tendency of a bundle of fibers of the sliver. Besides, such a problem also arises that the parallellism of fibers of a sliver is disturbed by frictional contact of the sliver with the sliver path, thus resulting in deterioration of the quality of a yarn obtained.

SUMMARY OF THE INVENTION

An object of the present invention is to provide a draft apparatus which can effectively compress a sliver to reduce the apparent thickness of the sliver without having a bad influence on conditions of a bundle of fibers of the sliver whereby the quality of a spun yarn is improved.

The construction of a draft apparatus according to the present invention which attains the object above is characterized in that at least one pair of sliver compressing members are disposed on a path of a sliver, and one of the sliver compressing members in pair has a circumferential recessed groove for receiving the sliver therein while the other of the sliver compressing members in pair has a circumferential rib adapted to be fitted into the recessed groove of the one sliver compressing member to press against the sliver received in the recessed groove, at least one of the sliver compressing members in pair being composed either of a rotatable roller or of an endless belt. Normally, the sliver compressing members are disposed backwardly of a draft apparatus so that a sliver may be supplied to the draft apparatus after it has been processed into a compressed condition.

It is necessary that one of the sliver compressing members be constituted as either a roller or an endless belt extended between two pulleys and that the roller or endless belt either be driven to rotate positively or be arranged for impositive rotation. The other of the compressing members may be a member similar to the roller or endless belt or may otherwise be a non-rotatable member. In the most preferable form of the sliver compressing members of the invention, one is a roller which is driven to rotate positively while the other is a roller which follows such rotation of the one roller to make impositive rotation, and the paired sliver compressing members are resiliently urged into engagement under pressure with each other by means of a spring or the like. The shape of each of the recessed groove and the rib is not limited to a specific one, but it may be such as to enable assured compression of a sliver without making it into a flattened form; for example, the recessed groove is formed to have a U- or V-shaped cross section.

Before a sliver is supplied to the draft apparatus, it is positioned into the recessed groove of the sliver compressing member. Thus, the sliver is fed to the draft apparatus after it has been compressed by the rib of the sliver compressing member. Such feeding of the sliver is effected smoothly without having its bundle of fibers disturbed since one or both of the sliver compressing members can rotate freely. Through this process, the sliver is compressed to have suitable thickness. Further, since the sliver is compressed while it is controlled from being expanded in a widthwise direction due to the presence of the recessed groove, it is not shaped into a flattened configuration. While it is also possible to arrange a plurality of pairs of such sliver compressing members along a path of a sliver so that the sliver may be compressed progressively, appearance of an inadvertent drafting phenomenon between the sliver compressing member pairs or between the sliver compressing members and the draft apparatus is not desirable for assuring a good quality of a yarn to be obtained. In order to prevent this phenomenon, following measures may be necessary: in particular, where the sliver compressing members make positive rotation, the speed of such rotation is coincided with the speed at which a sliver is drawn by the draft apparatus; where they make impositive rotation, such rotation is made smooth; and where they make no rotation, a coefficient of friction between a sliver and contact surfaces of the sliver compressing members with the sliver is held low. The sliver compressing members are most efficient where they are designed to make positive rotation.

According to the present invention, a sliver is compressed without being excessively expanded in a widthwise direction, and hence it is drafted in a condition in which it is reduced in its apparent thickness and is increased in density. As a result, the drafting efficiency is improved and a spun yarn of a high quality can be obtained. Particularly when compared with the case of compression of a sliver by means of such a guide as mentioned hereinbefore, since a sliver is fed under a compressed condition, an expanding tendency of the sliver can be reduced considerably. Further, since at least one of the sliver compressing members is rotatable, such feeding is effected smoothly and hence no disturbance is caused to appear in fibers of the sliver.

PREFERRED EMBODIMENTS OF THE INVENTION

Now, embodiments of the present invention will be described in detail with reference to the accompanying drawings.

Figure 1:
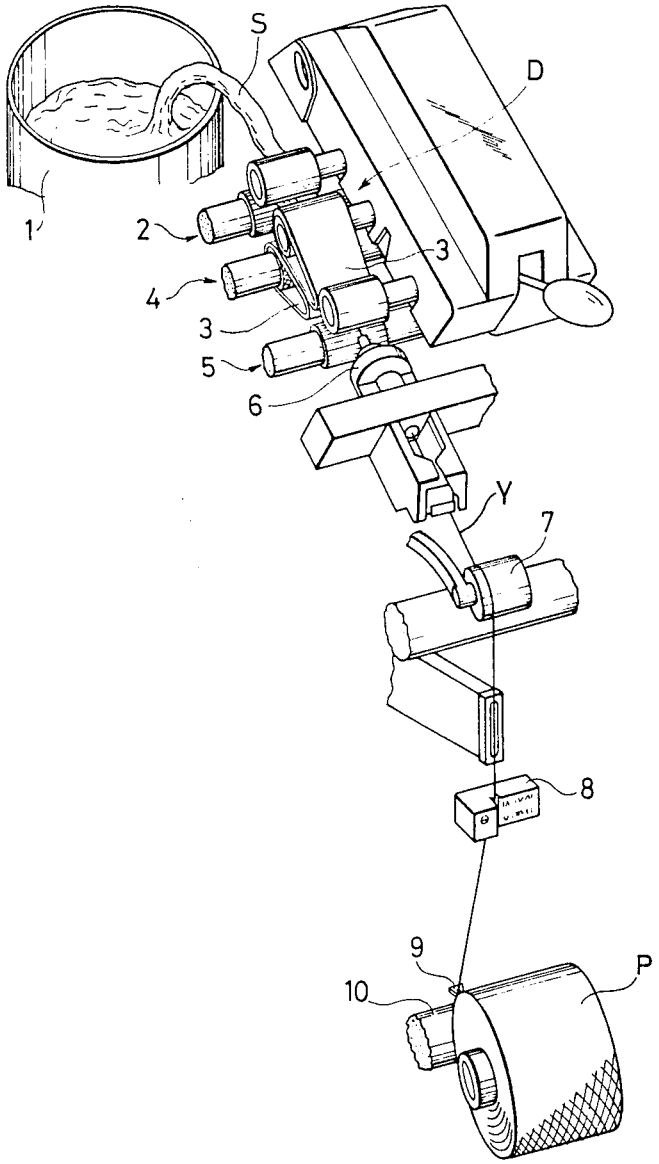
FIG. 1 is a diagrammatic representation showing a general construction of a pneumatic spinning frame.

Referring first to FIG. 1 which illustrates a general construction of a pneumatic spinning frame, a sliver S stored in the form of a wound coil in a sliver can 1 is supplied therefrom to a draft apparatus D. The draft apparatus D includes a plurality of pairs of rollers including back rollers 2, middle rollers 4 each having an apron 3, and front rollers 5. The rollers 2, 4 and 5 in each pair are rotated at circumferential speeds which increase in the order of the back rollers 2, middle rollers 4 and front rollers 5. The sliver S is fed forward while being sandwiched between and drafted by the rollers in each pair. After getting out of the draft apparatus D, the sliver S is now introduced into a spinning nozzle 6 at which it is acted upon and twisted by whirling compressed air flows to make a spun yarn Y. The spun yarn Y is then drawn out by means of a delivery roller 7, passes a yarn clearer 8, a traverse guide 9 and a friction roller 10, and is wound onto a package P.

Figure 2:
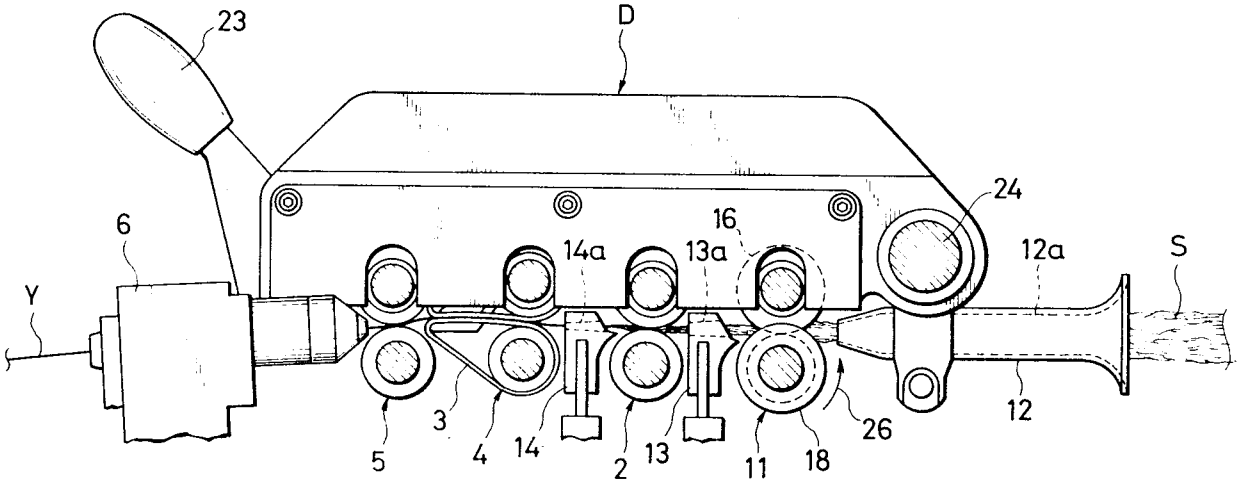
FIG. 2 is a side elevational view of a draft apparatus to which the present invention is applied.
Figure 3:
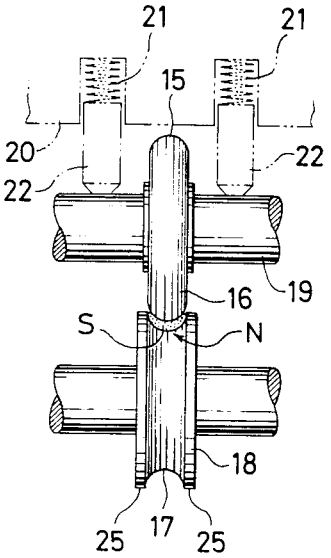
FIG. 3 is a front elevational view of sliver compressing members.

Reference is now had to FIG. 2 which illustrates an example of a draft apparatus D to which the present invention is applied. This draft apparatus D includes a pair of upper and lower sliver compressing members 11 at a location backwardly of the back rollers 2 in a direction of advancement of the sliver S. A first sliver guide 12 is located further backwardly of the sliver compressing members 11 and has a sliver path 12*a* which becomes narrower in the direction of advancement of the sliver S. Second and third sliver guides 13 and 14 are disposed between the sliver compressing members 11 and back rollers 2 and between the back rollers 2 and middle rollers 4, respectively, and each have a sliver path 13*a* or 14*a* similar to the sliver path 12*a* of the first sliver guide 12. The sliver compressing members 11 are constituted as a roller pair including an upper roller 16 having a rib 15 of a semicircular cross section formed around an outer circumferential periphery thereof, and a lower roller 18 having formed around an outer circumferential periphery thereof a recessed groove 17 which is somewhat complementary in shape to the rib 15 of the upper roller 16, as shown in FIG. 3. A pair of pins 22 which are urged downwardly by means of springs 21 mounted on a top roller support 20 are abutted against a shaft 19 on which the upper roller 16 is mounted to thus always urge the upper roller 16 towards the lower roller 18. The lower rollers of the roller pairs 2, 4, 5 and 11 are individually mounted for rotation on a machine bed of the spinning frame and are separately driven to rotate by means of a power source not shown while the upper rollers are individually mounted for free rotation on the top roller support 20. A lock lever 23 is provided to pivot the top roller support 20 around a shaft 24 between an open position in which a sliver S is set as seen in FIG. 2 and a closed position in which a sliver S is sandwiched between the rollers 2, 4, 5 and 11 of each roller pair. In the latter position of the top roller support 20, a sliver S is received in the recessed groove 17 of the lower roller 18 and is pressed from above by the rib 15 of the upper roller 16. The recessed groove 17 of the lower roller 18 is made sufficiently wide and deep to receive a sliver S therein while the rib 15 of the upper roller 16 is designed to have a shape and size such that it is closely fitted in the recessed groove 17 of the lower roller 18. Now, an example is given: the rib 15 and the recessed groove 17 are both 4 to 9 mm in width; the outer diameter of the upper roller 16 and the outer diameter of the lower roller 18 at the deepest portion of the recessed groove 17 are both 30 to 80 mm, and the pressing force against the upper roller 16 by the springs 21 is 0.3 to 2.5 kg. It is to be noted that the circumferential speed of the lower roller 18 is set to be equal to that of the back rollers 2 and that the sliver paths 12*a*, 13*a* and 14*a* of the sliver guides 12, 13 and 14 are each sufficiently wide to allow fibers of a sliver S to be maintained in their original arrangement.

Operations of the draft apparatus D as described above will be described below. A sliver S drawn out from the sliver can 1 is trimmed to have a circular cross section and is made sufficiently thin by means of the first sliver guide 12 to allow the sliver S to be smoothly received into the recessed groove 17 of the sliver compressing member 11. In this condition, the sliver S is fed to a contact point N between the upper roller 16 and the lower roller 18. At the contact point N, the sliver S is prevented from expanding in a widthwise direction by means of opposite side walls 25 of the recessed groove 17 and is thus pressed by the rib 15 of the upper roller 16 so that it is made thinner while maintained in a predetermined thickness in cross section. The sliver S thus compressed by positive rotation of the lower roller 18 in a direction of an arrow mark 26 is then fed out from the sliver compressing members 11 and guided by the second sliver guide 13 to the back rollers 2 whereafter they are fed in order through the third sliver guide 14, middle rollers 4 and front rollers 5 so as to be drafted successively thereby. In the process as described just above, the upper roller 16 is pressed against the sliver S by means of the pins 22 and hence is rotated at the same speed by the lower roller 18 thereby to feed the sliver S smoothly therefrom, thus causing no irregularity in the speed of feeding of the sliver S. Further, since the lower roller 18 has the same circumferential speed with the back rollers 2, there will appear no draft between those rollers 18 and 2.

FIGS. 4*a* to 4*d* illustrate different examples of sliver compressing members 11 which are each modified in shape of the rib 15 and the recessed groove 17.

Figure 4A:
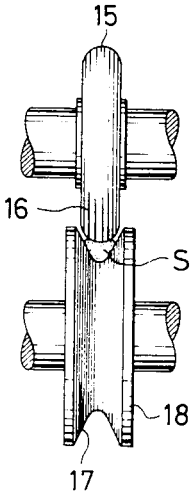
FIGS. 4*a* and 4*d* are similar views showing sliver compressing members in different forms of the present invention.
Figure 4B:
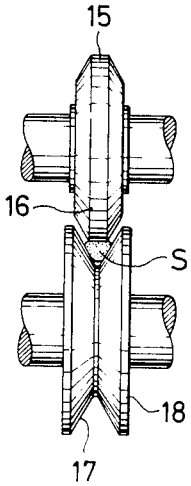
Figure 4C:
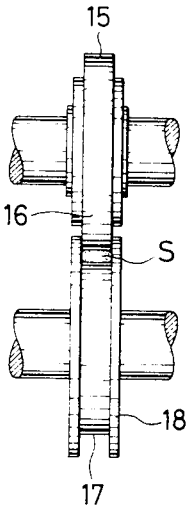
Figure 4D:
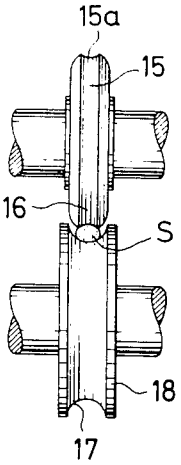
Figure 5A:
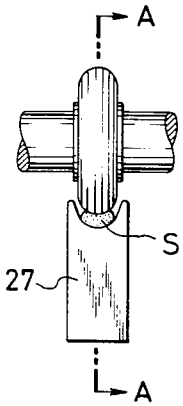
FIG. 5*a* is a similar view showing sliver compressing members in a further different form of the invention and FIG. 5*b* is a cross sectional view taken along line A—A of FIG. 5*a;*
Figure 5B:
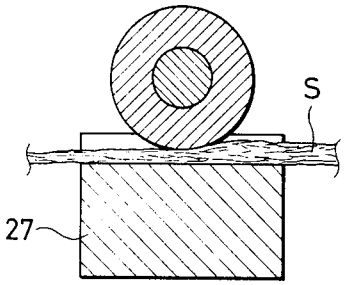
Figure 6A:
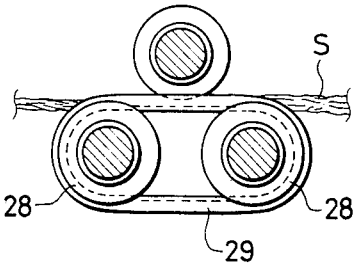
FIG. 6*a* is a cross sectional view showing sliver compressing members in a still further different form of the invention and FIG. 6*b* is a front elevational view of the sliver compressing members of FIG. 6*a;*

FIG. 4*a* illustrates sliver compressing members in which the rib 15 and the recessed groove 17 are different in shape from each other and the height of the rib 15 is lower than the depth of the recessed groove 17 so that the deepest portion of the recessed groove 17 may not be contacted with the rib 15. Since sliver S can be readily positioned adjacent the deepest portion of the recessed groove 17, the sliver compressing members of this example can assuredly prevent expansion of the sliver S in the widthwise direction. FIG. 4*b* illustrates sliver compressing members in which the recessed groove 17 has a V-shaped cross section while the rib 15 is flattened at the top thereof when compared with the sliver compressing members of FIG. 4*a* but they present substantially same effects with those of FIG. 4*a*. FIG. 4*c* illustrates sliver compressing members in which the recessed groove 17 has a channel-shaped cross section, and FIG. 4*d* illustrates sliver compressing members in which the rib 15 has a shallow recessed groove 15*a* formed on the top thereof, and similar effects to those as described above are expected to both of the sliver compressing members of FIGS. 4*c* and 4*d*.

Figure 7:
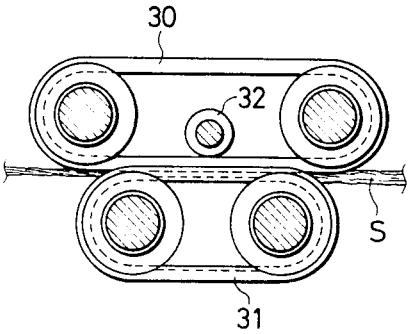
FIG. 7 is a cross sectional view showing sliver compressing members in a yet further different form of the invention.
Figure 6B:
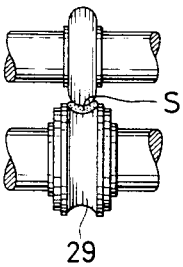
Figure 8:
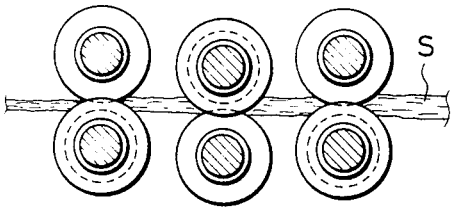
FIG. 8 is a similar view showing a still further different form of the invention.

FIGS. 5 to 8 illustrate further embodiments of sliver compressing members 11: FIGS. 5*a* and 5*b* illustrate sliver compressing members 11 in which one of them is constructed as a non-rotatable member 27; FIGS. 6*a* and 6*b* illustrate sliver compressing members 11 in which one of them is constructed as an endless belt 29 which is rotatably extended between two pulleys 28; FIG. 7 illustrates sliver compressing members 11 in which each of them is constructed as an endless belt 30 or 31 and in which a free roller 32 is contacted under pressure with one 30 of the endless belts 30 and 31; and FIG. 8 illustrates an arrangement which includes a plurality of pairs of the sliver compressing members 11 shown in FIGS. 3 or 4.

In the embodiments described hereinabove, the sliver compressing members 11 except the endless belts 29, 30 and 31 may be made of a material such as metal, rubber, plastics and so on, and it is also possible to reverse the arrangement of the upper and lower rollers 16 and 18. Further, the rib 15 or the recessed groove of the sliver compressing members 11 may be provided with such unevenness as will not cause damage to a sliver S.

Effects of the present invention as described hereinabove which were made clear through experiments will be described below in comparison with those of conventional apparatus. In particular, while, on one hand on the draft apparatus D as shown in FIG. 2 but using no sliver compressing member 11 therein, a spun yarn was obtained which presented 15.6 of RKM, 9.1% of CV, 9.9% of elongation, 11.3% of U%, and 8/12/64 of IPI/1000 m, on the other hand on the draft apparatus D according to the present invention, a spun yarn made of a same sliver S was obtained which presented 16.9 of RKM, 8.0% of CV, 10.5% of elongation, 11.4% of U%, and 8/32/52 of IPI/1000 m. In this way, it was confirmed that yarns obtained are improved sufficiently in characteristics so that the frequency of occurrences of yarn breaks during spinning is reduced to about a half, and thus the quality of yarns is improved remarkably.

What is claimed is:

1. A draft apparatus wherein a plurality of pairs of rollers for sandwiching a sliver under pressure therebetween to feed the same for drafting are arranged along a feed path of the sliver such that they have gradually increasing circumferential speeds in the direction of sliver advancement and at least one pair of sliver compressing members disposed on the sliver path upstream of the drafting action, one of said sliver compressing members in the pair having a circumferential recessed groove for receiving the sliver therein while the other of said sliver compressed members in the pair has a circumferential rib disposed in said recessed groove and configured to press against the sliver received in said recessed groove without causing substantial widthwise sliver expansion, and at least one of said sliver compressing members in the pair being rotatable.

2. A draft apparatus as claimed in claim 1, wherein a first one of the sliver compressing members is driven to rotate positively and the circumferential speed thereof is equal to that of a set of back rollers located upstream of said compressing members.

3. A draft apparatus as claimed in claim 2, wherein the other of said sliver compressing members is supported rotatably to follow the positive rotation of the first compressing member and the paired sliver compressing members are resiliently urged into engagement under pressure with each other by means of a spring or the like.

4. A draft apparatus as claimed in claim 1, wherein said sliver compressing members are a roller pair including an upper roller having a rib of a semicircular cross section formed around an outer circumferential periphery thereof, and a lower roller having formed around an outer circumferential periphery thereof a recessed groove complementary in shape to said rib.

5. A draft apparatus as claimed in claim 1, wherein said sliver compressing members are a roller pair and said circumferential recessed groove and said circumferential rib are so constructed on the rollers that a small space for receiving the sliver therein is formed between the rib and the groove when the rollers come to be abutted against each other.

6. A draft apparatus as claimed in claim 1, wherein one of said sliver compressing members is non-rotatable.

7. A draft apparatus as claimed in claim 1, wherein one of said sliver compressing member is constructed as an endless belt which is rotatably extended between two pulleys.

8. A draft apparatus as claimed in claim 1, wherein each of said sliver compressing members is an endless belt which is rotatably extended between two pulleys and a free roller is contacted under pressure with one of the endless belts.

9. A draft apparatus as claimed in claim 1, wherein the sliver compressing members comprise first and second circular sliver compressing members at least one of which is rotatable, said first compressing member having a rib formed on the perimeter portion thereof, and the second compressing member having a substantially mating groove formed therein such that when the rib and groove are mated, the rib does not touch the portion of the groove which is furthest radially inward relative to the center of the second member whereby substantial widthwise sliver expansion is precluded.

10. The draft apparatus of claim 9 wherein said rib is (i) rounded in cross-section, (ii) flat in cross-section with arcuate portions extending radially inwardly relative to the first member, or, (iii) flat in cross section.

11. The draft apparatus of claim 9 wherein the groove is (i) substantially V-shaped in cross-section, or (ii) substantially U-shaped in cross-section.

12. In a draft apparatus having a sliver inlet side and a sliver outlet side located downstream thereof, the improvement comprising:

means for compressing said draft sliver; and draft roller means for guiding said sliver downstream towards said sliver outlet side, said draft roller means being located downstream of said means for compressing.

13. The draft apparatus of claim 12 wherein said means for compressing includes a pair of rollers one of which has a rib on the perimeter thereof, and the other of which has a groove substantially mating with said rib.

14. The draft apparatus of claim 13 wherein when said rib and groove are mated, the portion of the rib furthest radially outward relative to the center of the roller having the rib, does not touch the portion of the groove which is furthest radially inward relative to the center of the roller having the groove.

* * * * *